US008176866B2

(12) United States Patent
Lenes et al.

(10) Patent No.: US 8,176,866 B2
(45) Date of Patent: May 15, 2012

(54) METHODS OF AND APPARATUS FOR MOORING AND FOR CONNECTING LINES TO ARTICLES ON THE SEABED

(75) Inventors: Hallgeir Lenes, Stavanger (NO); Christian Wathne, Stavanger (NO); Marius Tungseth, Steinkjer (NO); Kenneth John Whyte, Tananger (NO)

(73) Assignee: Acergy Norway AS, Sentrum (NO)

( * ) Notice: Subject to any disclaimer, the term of this patent is extended or adjusted under 35 U.S.C. 154(b) by 11 days.

(21) Appl. No.: 12/596,804

(22) PCT Filed: Apr. 18, 2008

(86) PCT No.: PCT/GB2008/050271

§ 371 (c)(1),
(2), (4) Date: Mar. 10, 2010

(87) PCT Pub. No.: WO2008/129320

PCT Pub. Date: Oct. 30, 2008

(65) Prior Publication Data

US 2010/0192828 A1 Aug. 5, 2010

(30) Foreign Application Priority Data

Apr. 20, 2007 (GB) ..... 0707673.0

(51) Int. Cl.
*B63B 21/00* (2006.01)

(52) U.S. Cl. ..... 114/230.2

(58) Field of Classification Search ..... 114/230.2, 114/230.23, 230.25, 230.26, 230.28, 230.29
See application file for complete search history.

(56) References Cited

U.S. PATENT DOCUMENTS

| | | | | |
|---|---|---|---|---|
| 4,417,830 | A | 11/1983 | Shotbolt | |
| 5,364,075 | A * | 11/1994 | Montgomery | 254/415 |
| 6,651,580 | B2 * | 11/2003 | Lay et al. | 114/293 |
| 2005/0022712 | A1 * | 2/2005 | Gundersen | 114/230.2 |

FOREIGN PATENT DOCUMENTS

| | | |
|---|---|---|
| EP | 1283158 | 12/2003 |
| GB | 2311503 | 10/1997 |
| WO | WO0132501 | 10/2001 |
| WO | WO02/062653 | 8/2002 |
| WO | WO2008/129320 | 10/2008 |

* cited by examiner

*Primary Examiner* — Stephen Avila
(74) *Attorney, Agent, or Firm* — Levy & Grandinetti

(57) ABSTRACT

The invention provides a tether connection apparatus for remotely interconnecting respective free ends of two portions of a mooring tether, such as that used to moor a floating production vessel to the seabed. The apparatus includes a frame, a winch mounted on the frame and operable to pull-in to the apparatus the free end of one of the portions of the mooring tether, subsequent to deployment of the apparatus. The apparatus also includes a connector mount on the frame for releasably mounting a connector. The connector is designed to interconnect the respective free ends of two portions of the mooring tether, once the winch has pulled into the apparatus the free end of a first of the portions of mooring tether. The mount is operable to release the connector subsequent to interconnection.

36 Claims, 7 Drawing Sheets

METHODS OF AND APPARATUS FOR MOORING AND FOR CONNECTING LINES TO ARTICLES ON THE SEABED

This invention relates to methods of and apparatus for connecting lines to articles on the seabed. The primary purpose is to provide a mooring apparatus and a method of mooring suitable for use with large offshore production vessels, such as drilling vessels and production buoys. However, the invention can be applied anywhere where it is desired to attach a heavy tether to an article already deployed on the seabed, for anchoring another article, or for lifting the seabed article itself. The term "tether" will be used to refer to a mooring leg, but also includes a hoisting cable or chain, unless the context requires otherwise.

Offshore production vessels need to be held within a strict geographical area at all times no matter the weather and tidal flow to ensure safe and continuous production and flow of hydrocarbons or gases. A typical mooring system for a production vessel comprises a loading buoy (otherwise known as a catenary anchor leg mooring (CALM) buoy) having a number of anchors deployed about it to hold the buoy in position via connecting lines. A typical arrangement for the deployment of these anchors is in a circle centred on the buoy. This type of arrangement means that the loads and forces that will be exerted on the buoy by the sea and climatic conditions can be resisted no matter the direction from which they originate. Normally any moored vessel will be able to rotate (or "weathervane") in relation to the buoy. In alternative installations, the vessel may be directly anchored to the seabed without use of a loading buoy. The present invention may be used to set an array of anchors in the seabed about the buoy/vessel. The anchors may comprise simple weights, suction anchors or drag-embedment anchors.

In conventional arrangements the buoy or production vessel is held in place by a series of anchors buried in the seabed. This normally means between 6 and 12 anchors equidistantly spaced (or spaced in groups) about the circumference of a circle formed with the buoy at its centre so that the buoy is held in place. Each anchor is at the end of a mooring leg extending from the vessel or buoy to the seabed. The terms "mooring leg" and "main tether" are used to encompass a variety of specific forms of tether, of which heavy chain is the most typical example. Other forms of mooring leg are of course possible, and often comprise sections of chain and sections of cable, connected together according to the properties required at each point along their extent.

Needless to say, the greater the depth of water in which the buoy is deployed the longer the chain and the greater the weight that has to be deployed. In order to deploy and embed the anchor conventional methods involve locating and deploying the anchor with it connected to a mooring leg of the buoy. The anchor is therefore deployed with the full weight of the chain, which forms a part of the mooring leg and connects the anchor to the loading buoy. The sheer weight even with the apparent lightening effect of the water becomes burdensome and difficult to operate with. In addition, the buoy or vessel to be moored has to be on site when the operation is being carried out, which could be a number of days. Logistically this is inefficient as the buoy/vessel is in effect out of service and the operation is more difficult to timetable.

Methods are known to deploy the anchor, either by itself or with a portion of the mooring leg chain or wire attached, before connection to the main mooring leg. One such method is disclosed in WO 02/062653. In this case connection is made by use of a Remotely Operated Vehicle (ROV) manipulator and vessel crane only, which is difficult to control properly and therefore slow to do, requiring particularly skilled ROV piloting. Other systems make use of purpose made mooring line connectors, such as disclosed U.S. Pat. No. 6,158,093, and as such increase the cost and complexity of the mooring line system.

It would be desirable, therefore, to be able to pull-in and connect subsea mooring line connections remotely without assistance from divers or purpose made mooring line connectors.

In a first aspect of the invention there is provided tether connection apparatus for remotely interconnecting respective free ends of first and second portions of a mooring tether, said apparatus comprising:

pull-in means operable to pull-in to said apparatus the free end of one of said portions of mooring tether, subsequent to deployment of the apparatus;

means for releasably mounting a connector, said means being designed to mount a connector that is operable to interconnect the respective free ends of said first and second portions of the mooring tether, once said pull-in means has pulled in to said apparatus the free end of a first of said portions of mooring tether, said means being operable to release the connector subsequent to interconnection.

Said tether connection apparatus may be operable to have said connector mounted to said means for releasably mounting a connector, wherein said connector is attached to the free end of a second of said portions of mooring tether, prior to deployment of the apparatus Said tether connection apparatus may be operable such that said first of said portions of mooring tether is attached to an anchor on the seabed, while the second of said portions of mooring tether is attached to an object to be moored.

Said means for releasably mounting a connector may be designed specifically to enable mounting of standard connectors, already commonly used for connecting lines, or portions of lines together. Such connectors may be any of the type commonly used to connect together, for example, chain with chain, chain with wire or wire with wire, as appropriate. Such connectors may include, a shackle with associated pin, spelter sockets, chain links or triplates. This means that expensive and complicated purpose made mooring line connectors can be dispensed with. Said means for releasably mounting a connector may be adapted to be able to mount two or more types of connectors.

Said apparatus may further comprise a suitable connector, pre-installed on said means for releasably mounting a connector.

Said apparatus may further comprise alignment means for aligning one portion of the mooring tether with the other prior to their being interconnected. Said alignment means may comprise a channel Said channel may be arranged to accommodate the free end of said portions of mooring tether to correctly locate and align said free end, for subsequent interconnection. Said channel may have a relatively wide opening, tapering inwards, thus forming a funnel shape. Said channel may include a restricted section for locating and orienting one of said free ends of portion of mooring tether. Said restricted section may include one or more locating pins. Said one or more locating pins may be designed to cooperate with and therefore properly locate and orientate a link of mooring chain. Said one or more locating pins may be adaptable, either by themselves or by way of the addition of an adaptor, so to be able to properly position wire, as well as chain. Said channel may be located on carriage allowing movement of said channel, and therefore said portion of said mooring leg located therein, relative to said first portion of the mooring tether and/or said connecting means. Said carriage may allow movement along the axis of the connection. The carriage may also allow for lateral movement.

Said pull-in means may comprise a winch.

In a further aspect of the invention there is provided a method of mooring an object to the seabed using the tether connection apparatus of the first aspect of the invention, said method comprising:

installing a connector on said tether connection apparatus;

installing at least one anchor on the seabed, said anchor having a first portion of mooring tether attached thereto.

installing said tether connection apparatus to the free end of a second portion of mooring tether, the other end of which being attached to the object to be moored;

connecting the free end of a second portion of mooring tether to said connector;

deploying said free end of the second portion of mooring tether with said tether connection apparatus attached thereto;

using said pull-in means to pull in the free end of said first portion of mooring tether to said tether connection apparatus;

connecting the free end of said first portion of mooring tether to said connector, thus interconnecting the first and second portions of mooring tether; and releasing the connector from said means for releasably mounting a connector.

Although some of the above steps rely on other steps being completed, it should be apparent to the skilled person that not all the steps necessarily need be done in the above order, and that some steps may be done simultaneously with others.

The step of installing said connector on said tether connection apparatus may be done as an initial step such that the connector is pre-installed on said tether connection apparatus. In this case said connecting of the free end of a second portion of mooring tether to said connector may be done prior to the deployment step, for example when installing said tether connection apparatus to the free end of a second portion of mooring tether. Some or all of these steps may be done on an installation vessel. Equally, the free end of a second portion of mooring tether may be connected to said tether connection apparatus before installation of the connector.

Alternatively the step of installing said connector on said tether connection apparatus may be done after deployment of the tether connection apparatus. In this case the connecting of the free end of a second portion of mooring tether to said connector will also be done after deployment, once said connector has been installed on said tether connection apparatus.

Said first and second portions of mooring tether may consist of chain or wire. In one embodiment said first portion consists of chain and said second portion consists of wire.

One or more of the steps including and subsequent to the deployment step may be done by a Remotely Operated Vehicle (ROV).

Said method preferably comprises the final step of recovering said tether connection apparatus. This may be done by an ROV.

Said method may further comprise the step of aligning one portion of the mooring tether with the other prior to their being interconnected. In one embodiment it is the free end of first portion of the mooring tether that is aligned relative to the free end of said second portion of the mooring tether and connector. Said free end of first portion of the mooring tether may be pulled into a channel comprised in said tether connection apparatus to correctly locate and align said free end, for subsequent interconnection. Said channel, and therefore said portion of said mooring leg located therein, may be moved relative to second portion of the mooring tether and said connecting means to aid alignment.

Said connector may comprise a shackle with associated pin, spelter sockets, chain links or triplates.

Said first portion of mooring tether may be pre-routed on the seabed prior to it being pulled-in to said tether connection apparatus.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1A:
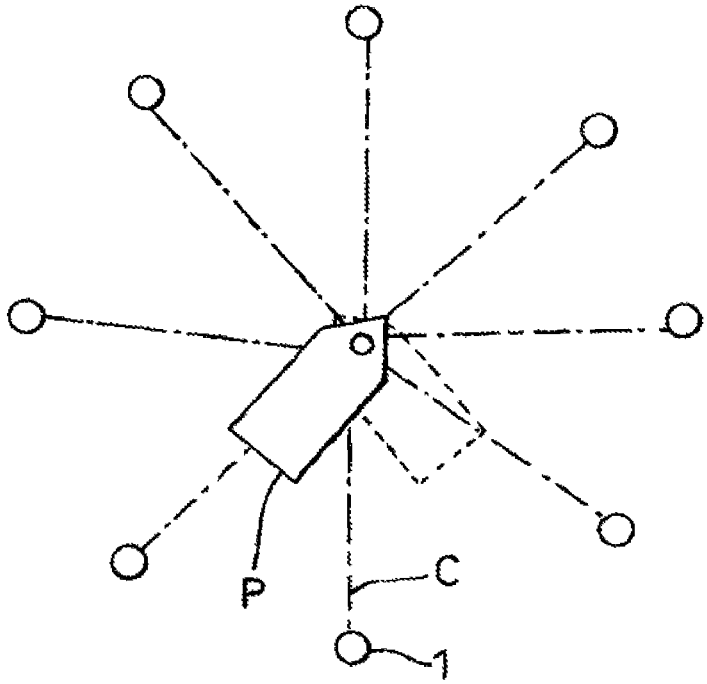
FIG. 1 shows (a) a plan of a production vessel mooring arrangement, and (b) a side view of part of the arrangement.
Figure 1B:
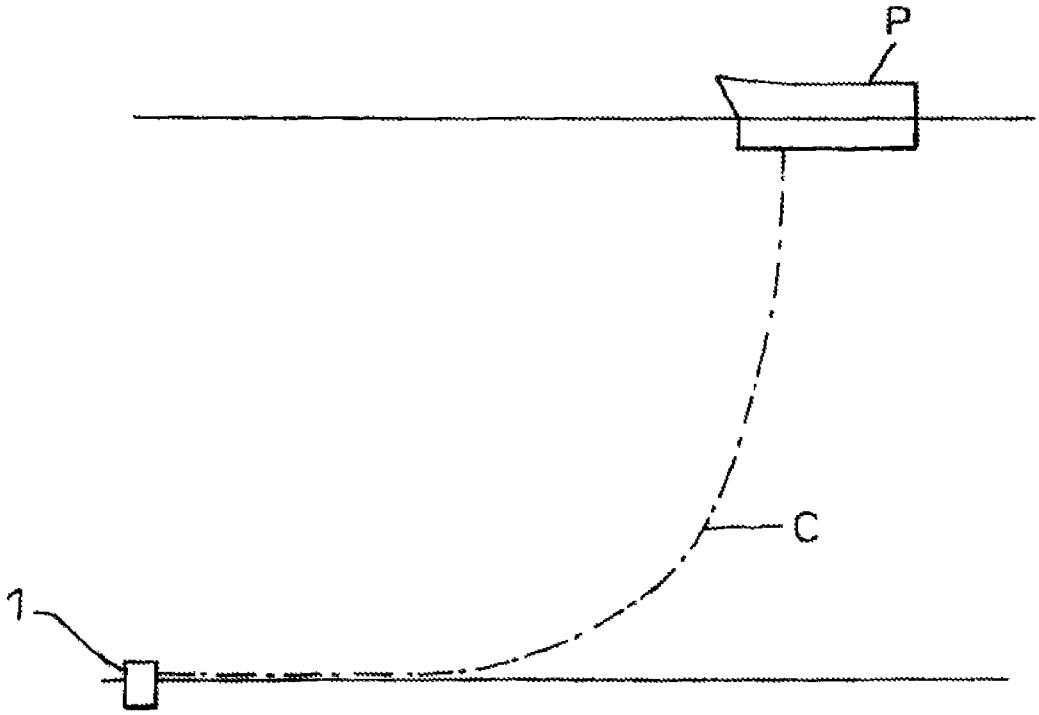

FIG. 1 of the accompanying drawings shows a typical schematic representation of an installation of a floating production vessel P moored in place via buoy B such that it can "weathervane" around the buoy B. The buoy B is held in place using 8 (eight) anchors 1 fixed to the buoy B by chains C of respective mooring legs and buried in the seabed so that they are equally spaced around the circumference of a circle centred on the vessel P.

Figure 2:
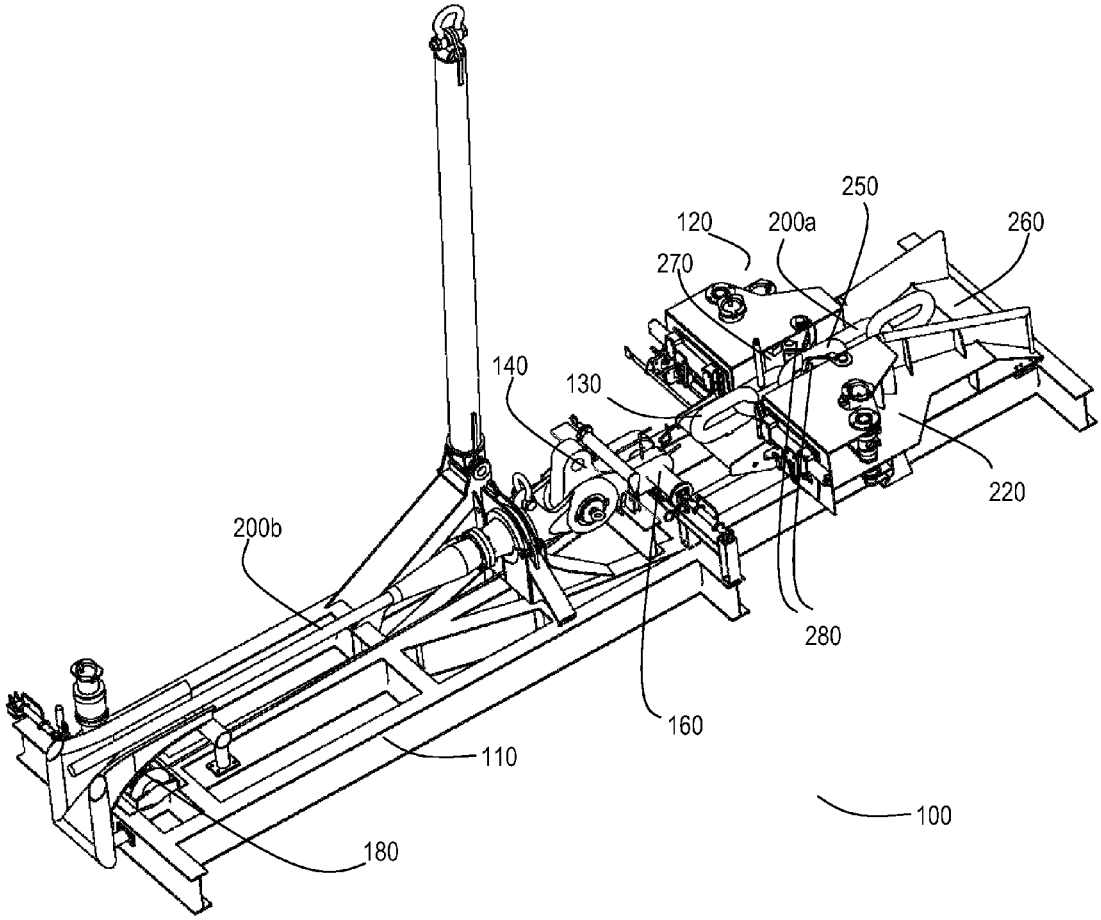
FIG. 2 shows a pull-in and connection device in accordance with an embodiment of the invention.

FIG. 2 shows a device 100 suitable for undertaking chain and wire pull-in and connection of mooring legs subsea. The mooring legs in this example are Chain-Wire, but could be Chain-Chain, Wire-Wire. or Wire-Chain. The device 100 comprises a frame 110, an alignment system 120, a connector 140 and shackle/socket pin 160, preinstalled on said frame 110, and a pull in winch 180. Also shown are the first chain section 200*a* of the mooring leg 200 and the second wire section 200*b* of the mooring leg 200.

Considering the alignment system 120 of this embodiment in more detail, this comprises a carriage 220 movable along the frame 110 on tracks 240. On the carriage is a funnel 260 leading to a narrow channel 270 with locating pins 280 therein.

In use, the device 100 is pre-installed onto one end of one of the portions 200*b* of the mooring leg 200 to be connected. The device 100 has remote operated functions, controlled by, and powered from, a Remotely Operated Vehicle (ROV), for pull-in, alignment and locking of the other portion of the mooring leg, installation and securing of shackle/socket pin and release of connection from device 100. Pull-in and connection operations can be performed on seabed or midwater.

Figure 3A:
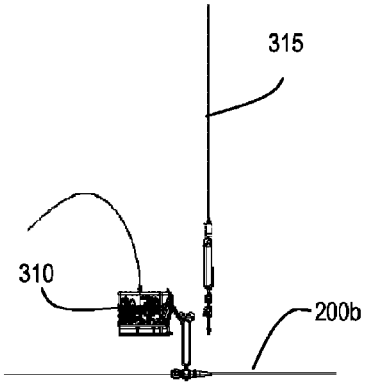
FIGS. 3*a* to 3*k* depict a method of installing a mooring leg using the device according to an embodiment of the invention.

FIGS. 3*a* to 3*k* depict a method of installing a mooring leg 200 using the device 100 described above. To begin, the loading buoy that is to be moored is suspended by a crane, temporary suspended midwater and held in place by a deadman anchor on the seabed or held in position on the surface. The mooring anchor 1 is also installed on the seabed with its portion of the mooring leg 200*a* (in this case a chain, although it may be wire, rope or of other suitable construction) attached, this chain being pre-routed on the seabed such that its free end is in the vicinity of the buoy;

FIG. 3*a* shows one end of the other portion of the mooring leg 200*b*, which had been previously abandoned on the seabed, being picked up by a Remotely Operated Vehicle (ROV) 310 and attached to the crane wire 315 of the installation vessel. (The other end of this portion of the mooring leg 200*b* is attached to the loading buoy).

Figure 3B:
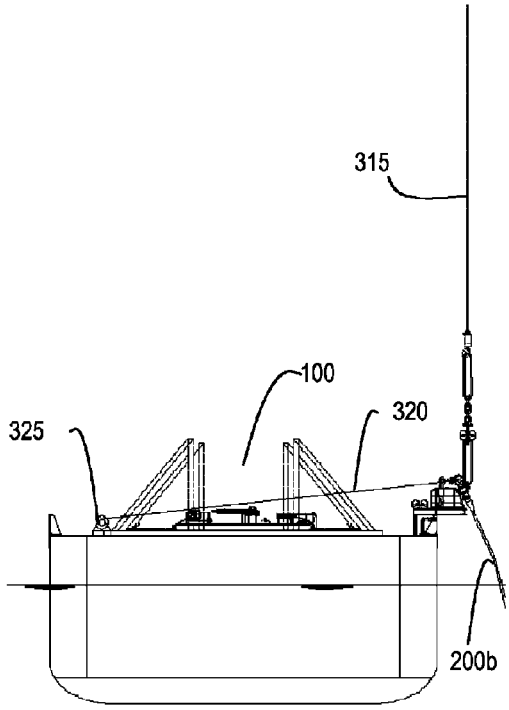

In FIG. 3*b*, this end of the portion of the mooring leg 200*b* (which in this case is a wire, but may again be of other suitable construction) is lifted to the work platform 315 of the installation vessel, where it is attached by line 320 to a tugger 325. In place on the installation vessel is device 100. At this point buoyancy is removed from the portion of mooring leg 200*b*.

The end of the mooring leg 200*b* is lifted further by the crane wire 315, and with the catenary weight taken by holdback slings 330 and with the help of the tugger 325, the end of the mooring leg 200*b* is lowered toward the device 100.

Figure 3C:
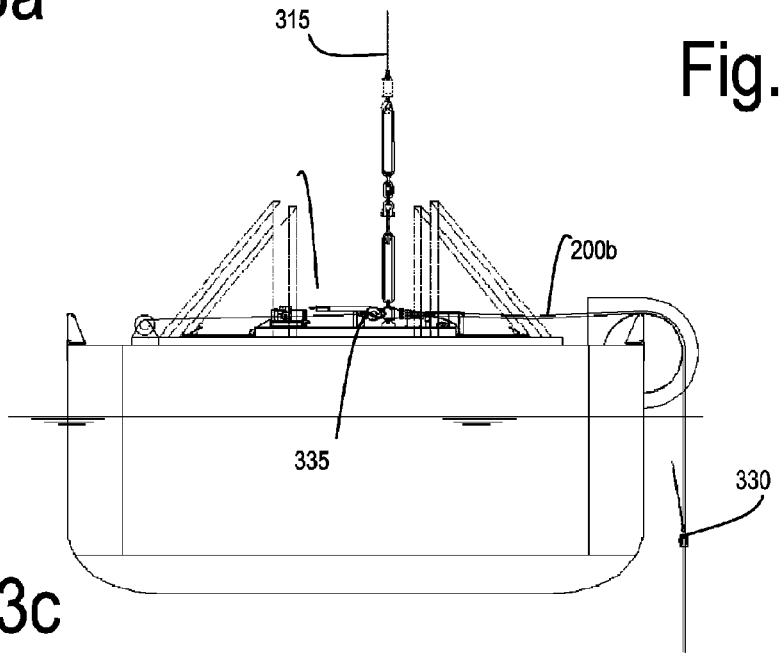

FIG. 3*c* shows the end of the mooring leg 200*b* having been lowered into place on device 100. The socket 335 at the end of the mooring leg 200*b* is then placed in the clevis of the device 100 and the socket 335 body is strapped down to the device 100.

Figure 3D:
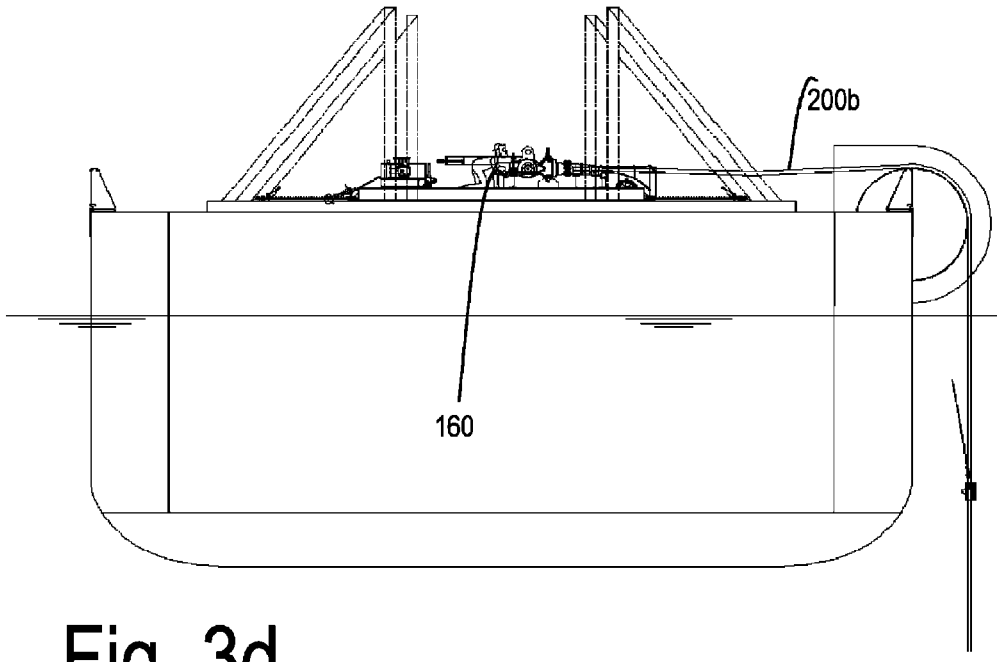

FIG. 3*d* shows the device 100 effectively installed to the end of the mooring leg wire portion 200*b*. On the work platform 315 of the installation vessel, a shackle and pin 160 with locking plate is installed to the socket 335 at the end of the mooring leg 200*b*, and an ROV releasable locking beam is used to secure the fixing to the device 100.

Figure 3E:
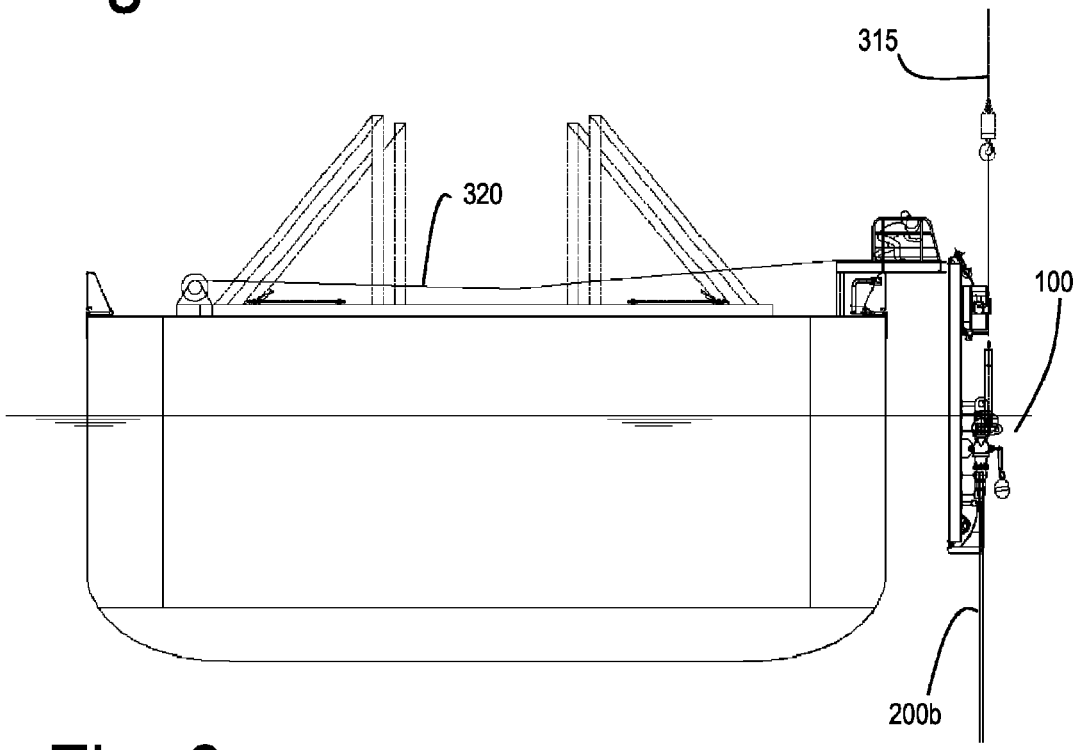
Figure 3F:
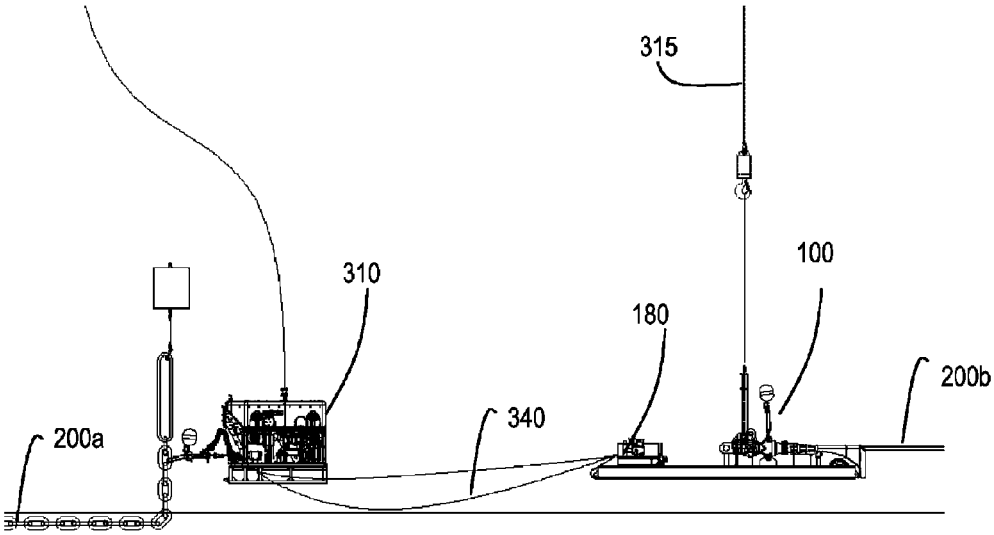
Figure 3G:
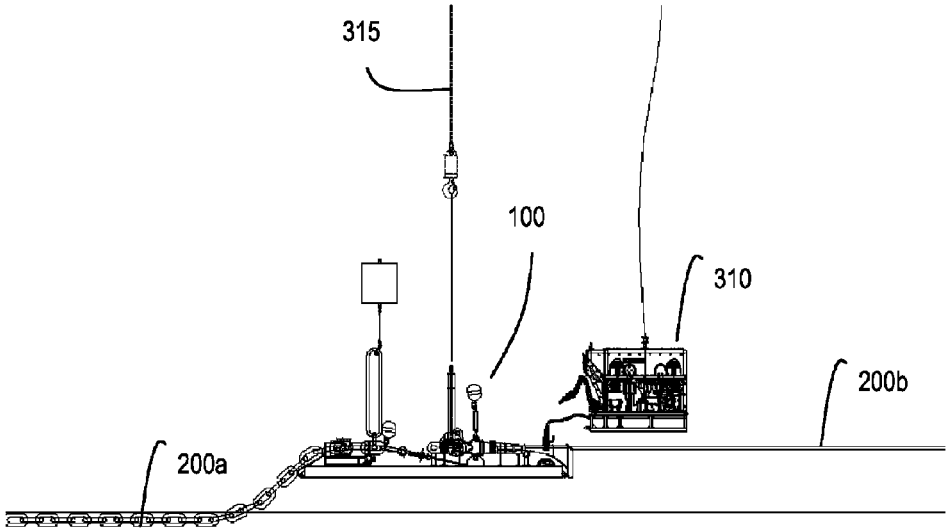

FIG. 3*e* shows the tugger line 320 being disconnected, this being done after disconnection of the holdback slings and attachment of the device 100 to the crane wire 315. The wire portion 200*b* of the mooring leg 200, with the device 100 attached can now be deployed;

FIG. 3*f* shows the device having been lowered to about 1 meter above the seabed, and within about 20 meters of the end of the chain portion 200*a* to which it is to be connected. The pull-in wire/tether 340 from the winch 180 on the device 100 is attached to the free end of the chain mooring leg 200*a* (pre-routed on seabed, the other end being attached to the anchor);

FIG. 3*g* shows the ROV 310 using its torque tool to operate the winch 180 so that the pre-routed chain mooring leg 200*a* is pulled in to the device 100, until the chain hits stops on the device 100; In doing so it pulls the chain 200*a* into a funnel or channel 260. This funnel or channel 260 aligns the chain connector, in this case the final chain link 130, laterally with the wire connector 140. while the pins 280 locate in another chain link 250, thus holding that link 250, and as a result the connector 130, vertical.

The ROV then uses its torque tool to lock and align the chain 200*a* in the device 100. The winch wire 340 is then removed, while a stop is placed between chain links 1 and 3 to hold the chain in place.

Figure 3H:
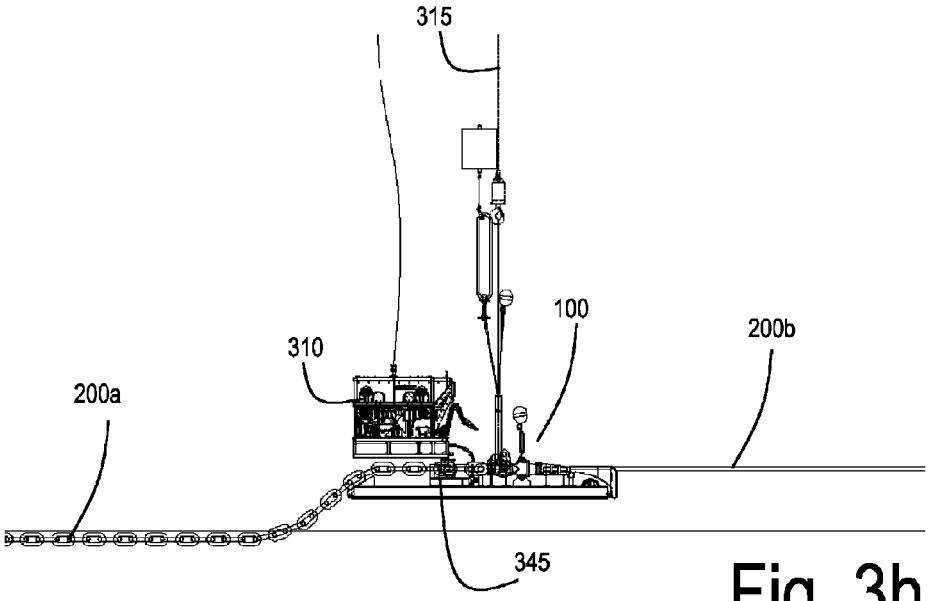

FIG. 3*h* shows the ROV using its torque tool to move the alignment carriage 220 toward the shackle 160. Precise longitudinal alignment can be made moving the carriage along the frame until the end of the chain 100*a* is aligned properly with the shackle 160. This carriage may also be movable laterally to aid alignment.

Figure 3I:
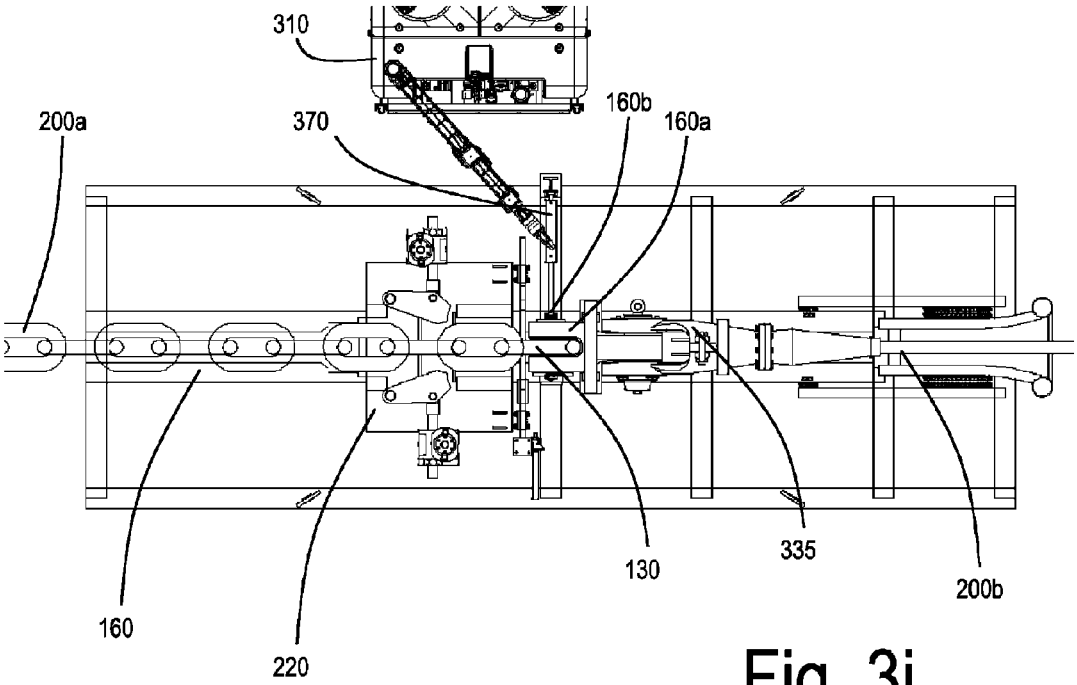
Figure 3J:
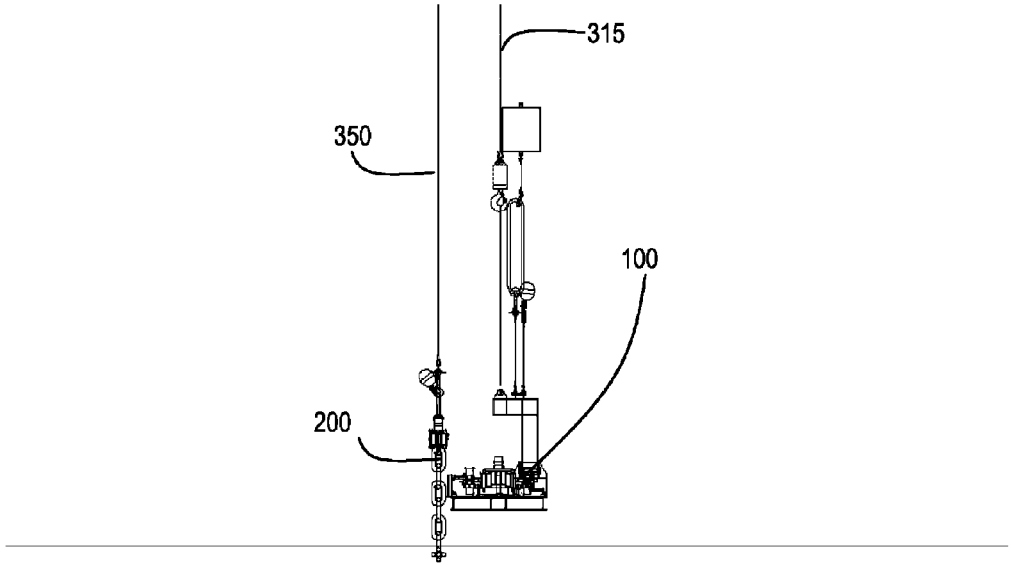

Once aligned, each of the connectors are locked relative to each other to prevent misalignment during engagement of shackle/socket pin 160;

FIG. 3*i* shows the ROV using a pin insertion tool 370 to engage and secure the socket pin 160*b* into the shackle 160*a* and chain link 130 A C-plate can then secure the socket pin, making a permanent connection. Once made the surface winch line 350 can be attached to the connection, and the locking bar and straps attaching the connection to the device 100 can be released FIG. 3*j* shows the connection being lifted by the winch clear of the device 100. Device 100 is then recovered to the installation vessel.

Figure 3K:
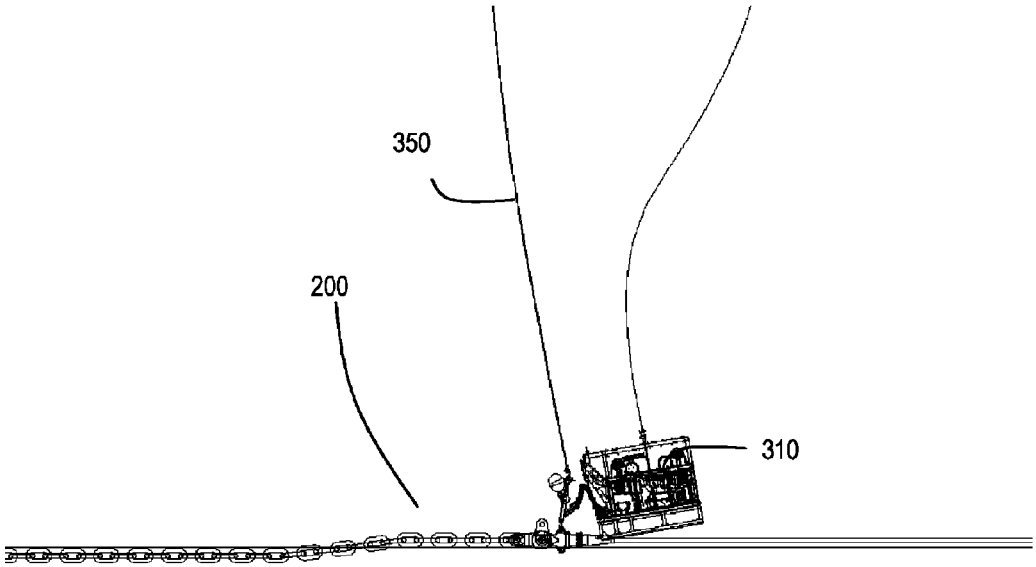

FIG. 3*k* shows the ROV releasing the shackle connected to the socket, the connection now being complete.

The above steps can then be repeated for the next mooring leg connection.

The above embodiments are provided for illustration only, and other embodiments and variations are envisaged without departing from the spirit and scope of the invention. For example, the connector (a shackle and socket pin in the above example, although use of any suitable connector is envisaged) does not need to be pre-installed, and instead could be installed after deployment using an ROV. Furthermore, the above example is shown in relation to mooring a loading buoy, but other applications for this apparatus and method include, but are not limited to, the connections for the mooring lines of FPSOs (Floating, Production, Storage and Offloading vessels), rigs and riser systems.

The alignment system shown, in particular, is subject to many variations and embodiments. For example, the pins 280 of the alignment system may be adapted should it be a wire portion of a mooring leg that requires pulling in and aligning. Said pins 280 may be adaptable, either by themselves or by way of the addition of an adaptor, so to be able to properly position both chain and wire.

The invention claimed is:

1. A tether connection apparatus for remotely interconnecting respective free ends of first and second portions of a mooring tether, said apparatus comprising:

a frame;

a winch mounted on the frame and operable to pull-in to said apparatus the free end of one of said portions of mooring tether, subsequent to deployment of the apparatus;

a connector mount on the frame, said connector mount being designed to mount a connector that is operable to interconnect the respective free ends of said first and second portions of the mooring tether, once said winch has pulled in to said apparatus the free end of a first of said portions of mooring tether, said connector mount being operable to release the connector subsequent to interconnection.

2. Apparatus as claimed in claim 1 wherein said tether connection apparatus is operable to have said connector mounted to said connector mount, wherein said connector is attached to the free end of a second of said portions of mooring tether, prior to deployment of the apparatus.

3. Apparatus as claimed in claim 1 wherein said tether connection apparatus is operable to connect a first of said portions of mooring tether that is attached to an anchor on the seabed, and a second of said portions of mooring tether that is attached to an object to be moored.

4. Apparatus as claimed in claim 1 wherein said connector mount is designed specifically to enable mounting of standard connectors, already commonly used for connecting lines, or portions of lines, together.

5. Apparatus as claimed in claim 4 wherein said standard connectors are connectors for connecting together one pair of the following group of pairs: chain with chain, chain with wire and wire with wire.

6. Apparatus as claimed in claim 5 wherein such connectors include one or more of the following: a shackle with associated pin, spelter sockets, chain links or triplates.

7. Apparatus as claimed in claim 1 wherein said connector mount is adapted to be able to mount two or more types of connectors.

8. Apparatus as claimed in claim 1 wherein said apparatus further comprises a suitable connector, pre-installed on said connector mount.

9. Apparatus as claimed in claim 1 wherein said apparatus comprises alignment means for aligning one portion of the mooring tether with the other prior to their being interconnected.

10. Apparatus as claimed in claim 9 wherein said alignment means comprises a channel.

11. Apparatus as claimed in claim 10 wherein said channel is arranged to accommodate the free end of said portions of mooring tether to correctly locate and align said free end, for subsequent interconnection.

12. Apparatus as claimed in claim 10 wherein said channel has a relatively wide opening, tapering inwards, thus forming a funnel shape.

13. Apparatus as claimed in claim 10 wherein said channel comprises a restricted section for locating and orienting one of said free ends of portion of mooring tether.

14. Apparatus as claimed in claim 13 wherein said restricted section comprises one or more locating pins.

15. Apparatus as claimed in claim 14 wherein said one or more locating pins is designed to cooperate with and therefore properly locate and orientate a link of mooring chain.

16. Apparatus as claimed in claim 14 wherein said one or more locating pins is adaptable, either by themselves or by way of the addition of an adaptor, so to be able to properly position wire, as well as chain.

17. Apparatus as claimed in claim 10 wherein said channel is located on carriage allowing movement of said channel, and therefore said portion of said mooring leg located therein, relative to said first portion of the mooring tether and/or said connector mount, said carriage may allow movement along the axis of the connection, the carriage may also allow for lateral movement.

18. Apparatus as claimed in claim 1 wherein said pull-in means comprises a winch.

19. A method of mooring an object to the seabed comprising the steps of: installing a connector on a tether connection apparatus; installing at least one anchor on the seabed, said anchor having a first portion of mooring tether attached thereto; installing said tether connection apparatus to the free end of a second portion of mooring tether, the other end of which being attached to the object to be moored; connecting the free end of a second portion of mooring tether to said connector; deploying said free end of the second portion of mooring tether with said tether connection apparatus attached thereto; using said pull-in means to pull in the free end of said first portion of mooring tether to said tether connection apparatus; connecting the free end of said first portion of mooring tether to said connector, thus interconnecting the first and second portions of mooring tether; and releasing the connector from said means for releasably mounting a connector.

20. Method as claimed in claim 19 wherein the step of installing said connector on said tether connection apparatus is done as an initial step such that the connector is pre-installed on said tether connection apparatus.

21. Method as claimed in claim 20 wherein said connecting of the free end of a second portion of mooring tether to said connector is done prior to the deployment step.

22. Method as claimed in claim 20 wherein at least some of the steps is done on an installation vessel.

23. Method as claimed in claim 19 wherein the free end of a second portion of mooring tether is connected to said tether connection apparatus before installation of the connector.

24. Method as claimed in claim 19 wherein the step of installing said connector on said tether connection apparatus is done after deployment of the tether connection apparatus.

25. Method as claimed in claim 24 wherein the connecting of the free end of a second portion of mooring tether to said connector is also done after deployment, once said connector has been installed on said tether connection apparatus.

26. Method as claimed in claim 19 wherein said first and second portions of mooring tether consist of chain or wire.

27. Method as claimed in claim 26 wherein said first portion consists of chain and said second portion consists of wire.

28. Method as claimed in claim 19 wherein one or more of the steps including and subsequent to the deployment step is done by a Remotely Operated Vehicle (ROV).

29. Method as claimed in claim 19 wherein said method preferably comprises the final step of recovering said tether connection apparatus.

30. Method as claimed in claim 29 wherein the recovery step is done by an ROV.

31. Method as claimed in claim 19 wherein said method comprises the step of aligning one portion of the mooring tether with the other prior to their being interconnected.

32. Method as claimed in claim 31 wherein it is the free end of first portion of the mooring tether that is aligned relative to the free end of said second portion of the mooring tether and connector.

33. Method as claimed in claim 32 wherein said free end of first portion of the mooring tether is pulled into a channel comprised in said tether connection apparatus to correctly locate and align said free end, for subsequent interconnection.

34. Method as claimed in claim 33 wherein said channel, and therefore said portion of said mooring leg located therein, is moved relative to second portion of the mooring tether and said connecting means to aid alignment.

35. Method as claimed in claim 19 wherein said connector comprises a shackle with associated pin, spelter sockets, chain links or triplates.

36. Method as claimed in claim 19 wherein said first portion of mooring tether is pre-routed on the seabed prior to it being pulled-in to said tether connection apparatus.

* * * * *